United States Patent [19]

Schick et al.

[11] 4,283,293

[45] Aug. 11, 1981

[54] METAL WORKING LUBRICANT COMPOSITIONS

[75] Inventors: John W. Schick, Cherry Hill; Robert H. Davis, Pitman; Harry J. Andress, Wenonah, all of N.J.

[73] Assignee: Mobil Oil Corporation, New York, N.Y.

[21] Appl. No.: 931,575

[22] Filed: Aug. 7, 1978

[51] Int. Cl.[3] ..... C10M 3/06

[52] U.S. Cl. ..... 252/32; 252/51.5 A; 252/51.5 R; 252/47.5

[58] Field of Search ..... 252/32, 47.5

[56] References Cited

U.S. PATENT DOCUMENTS

| | | | |
|---|---|---|---|
| 3,600,327 | 8/1971 | Hu | 252/47.5 X |
| 3,664,955 | 5/1972 | Panzer | 252/47.5 |
| 3,676,346 | 7/1972 | Hu | 252/47.5 |
| 3,809,649 | 5/1974 | Van Doorne | 252/32 X |
| 3,843,533 | 10/1974 | Cullen et al. | 252/47.5 |
| 3,931,021 | 1/1976 | Lundberg | 252/32 X |
| 4,045,363 | 8/1977 | Lee et al. | 252/47.5 X |
| 4,086,172 | 4/1978 | Lowe | 252/47.5 |
| 4,102,796 | 7/1978 | Lowe | 252/47.5 |
| 4,119,549 | 10/1978 | Davis | 252/47.5 X |
| 4,119,550 | 10/1978 | Davis et al. | 252/47.5 X |
| 4,144,181 | 3/1979 | Elliott et al. | 252/47.5 X |
| 4,161,451 | 7/1979 | Lowe | 252/47.5 X |

*Primary Examiner*—Paul F. Shaver

*Attorney, Agent, or Firm*—Charles A. Huggett; Michael G. Gilman; Claude E. Setliff

[57] ABSTRACT

A lubricant concentrate for use in metal processing comprises a sulfur compound such as a sulfurized olefin or sulfurized mineral oil and an ester prepared from a fatty acid having 12 to 40 carbon atoms or the dimer thereof or a polyalkenylsuccinic acid or anhydride and a hydroxyl-containing amine.

22 Claims, No Drawings

METAL WORKING LUBRICANT COMPOSITIONS

BACKGROUND OF THE INVENTION

1. Field of the Invention

This invention relates to lubricants used in metal working.

2. Description of the Prior Art

Modern metal-working methods requiring lubricant emulsions use procedures that have severely tested present lubricants. It is known in the art, for instance, that can forming operations, i.e. cupping, drawing and ironing, require emulsions with special properties. However, no art is known which discloses or suggests the compositions provided by this invention.

U.S. Pat. No. 3,071,544 describes emulsions, primarily for rolling oils, containing components including a small amount of an organic acid which may be reacted with other components to provide oil soluble soaps, such as soaps of alkanolamines. U.S. Pat. No. 3,311,557 describes emulsions containing a fatty acid, a polyol and ethanolamine, which latter reacts with the acid to provide a ratio of base number to acid number of 0.15 to 0.4.

U.S. Pat. No. 3,697,428 is concerned with an oil soluble composition made by reacting, for example, a polyolefinsubstituted succinic anhydride and a di-or trihydric alcohol and a polyhydric alcohol containing at least four hydroxyl groups U.S. Pat. No. 3,381,022 teaches ester derivatives of a hydrocarbon-substituted succinic acid, the hydrocarbon being an aliphatic chain containing at least 50 carbon atoms and a mono-or polyhydric alcohol, phenols and naphthols. They are useful as additives to hydrocarbon oils and lubricating compositions or fuels.

Both of U.S. Pat. Nos. 3,523,895 and 3,723,314, as well as 3,723,313, disclose an emulsifiable oil containing acid, triethanolamine and oil.

Of interest also are U.S. Pat. Nos. 2,588,412; 3,368,971; 3,448,049; 3,451,931; 3,458,444; and 3,676,483.

SUMMARY OF THE INVENTION

In accordance with the invention there is provided an emulsifiable lubricant composition comprising, in the neat form, a sulfurized olefin or sulfurized mineral oil and from about 0.5% to about 95% by weight thereof of (a) the reaction product made by reacting a $C_{12}$ to $C_{20}$ monocarboylic acid or a dimer thereof or an alkenylsuccinic anhydride or acid wherein the alkenyl is derived from a mixture of $C_{16}$–$C_{28}$ olefins with (1) a hydroxyalkylamine containing 2 to 100 carbon atoms, or (2) a hydroxypolyetheramine of the formula $$\begin{array}{c} RN-R' \\ | \\ R'' \end{array}$$

wherein R is a $C_8$ to $C_{18}$ hydrocarbyl group and x is from 1 to 50, R' is a $-(CH_2CH_2O)_xCH_2CH_2OH$ group or a $-(CH_2CH_2CH_2O)_xCH_2CH_2CH_2OH$ group and R'' is selected from R and R''; or (b) the reaction product of (a) (2) and a rosin soap; or (c) the product of (a) or (b) and from about 0.5% to about 15% by weight thereof of a $C_2$ to $C_{10}$ monocarboxylic acid.

Preferably, the composition comprises from about 1% to about 10% of the products (a), (b) and (c) above and from about 99% to about 90% by weight of sulfurized olefin or sulfurized mineral oil. The rosin soap is the potassium salt of rosin acid wherein the acid is mostly abietic and is present with product (a) (2) to the extent of from about 1% to about 10% by weight. The invention also includes a method of working metals using the above composition.

DESCRIPTION OF SPECIFIC EMBODIMENTS

As has been stated, the lubricants used in this invention will broadly comprise in the neat form, from about 0.5% to about 95% by weight of the emulsifiable lubricant composition. If desired, the lubricants can be emulsified in water, using well known emulsifiers. When so used, the emulsifiable lubricant will present within the range of from about 1% to about 50%, preferably from about 3% to about 20%, all by weight.

Included among the hydroxyalkylamine compounds are trialkanolamine, wherein the alkane portion has from 2 to 100 carbon atoms. For example, these specifically included are: triethanolamine, triisopropylamine, and the like. The preferred member is triethanolamine.

Sulfurized olefins useful herein are generally described in U.S. Pat. No. 3,703,504, the entirety of which is incorporated herein by reference. This class of reactant, however, is not limited to such patent. Other sulfurized olefins made by variations of this process or by other processes known to the art which contain reactive olefinic sites may also be employed in this invention.

The sulfurized olefins may be obtained via a process which comprises sulfohalogenating an olefin with a sulfur halide in the presence of a catalytic quantity of a lower aliphatic alcohol, or other appropriate catalyst to form a sulfohalogenated organic intermediate, and thereafter sulfurizing and dehalogenating said intermediate in the presence of a substantial quantity of lower aliphatic alcohol by treatment with an aqueous alkali metal sulfide solution, or an aqueous alkali metal monosulfide solution (which can be derived, for example, from a spent aqueous alkali metal hydroxide effluent from hydrocarbon purification) having a substantial combined sulfur content thus producing an organic sulfide of high sulfur content.

A wide variety of olefinic substances may be charged to the initial or sulfochlorination reaction including olefins having a single double bond with terminal or internal double bonds and containing from about 2 to 8 or more carbon atoms per molecule in either straight, branched chain or cyclic compounds, and these may be exemplified by ethylene, propylene butene-1, cis and trans butene-2, isobutylene, diisobutylene, triisobutylene, the pentenes, cyclopentene, the hexenes, cyclohexene, the octenes, decene-1, etc. In general, $C_3$–$C_6$ olefins or mixtures thereof are desirable for preparing sulfurized products for use in preparing the inventive additives. We prefer these since the combined sulfur content of the product decreases with increasing carbon content yet its miscibility with oil is lower for propylene and ethylene derivatives.

The monocarboxylic acids useful in this invention include the acetic, propionic, butyric, pentanoic, octanoic and decanoic acids.

The $C_{12}$ to $C_{20}$ acids include the dodecanoic, octadecanoic and linoleic acids.

We have found that a particularly effective R group attached to the succinic acid or anhydride can be derived from a mixture of $C_{16}$–$C_{28}$ olefins. One such olefin mixture is the bottoms from an olefin oligomerization and the mixture will have the following composition:

TABLE 1

| Ingredient | % by wt. | Other |
|---|---|---|
| Olefin (chain length) | | |
| $C_{16}$ | 2 max. | |
| $C_{18}$ | 5–15 | |
| $C_{20}$ | 42–50 | |
| $C_{22}$ | 20–28 | |
| $C_{24}$ | 6–12 | |
| $C_{26}$ | 1–3 | |
| $C_{28}$ | 2 max. | |
| Alcohol | 10 max. | |
| Paraffin | 5 max | |
| Iodine NO | | 74 min. |
| Peroxide | | 10 ppm max. |
| Olefin types by NMR | | |
| Vinyl | 28–44 | |
| Branched | 30–50 | |
| Internal | 26–42 | |

Because of the source of the olefin mixture, one does not always get the same product from successive batches, but each mixture used will have a composition falling within the ranges stated and will be equally effective for use in this invention. The olefin mixture is reacted with maleic anhydride or acid to give the polyolefin-substituted succinic compound at from about 150° C. to about 250° C.

The reaction of the acid with the hydroxyamine compounds (which term includes both the hydroxy alkylamines and the hydroxypolyetheramine types) can be carried out at from about 100° C. to about 300° C., preferably 150° C. to 250° C. and for a time sufficient to form the ester, usually about 3 hours to about 6 hours. The time and temperature of reaction are not critical and will obviously depend in some measure upon the reactants selected.

The addition of the rosin soap or monocarboxylic acid is done at room temperature or at moderately elevated temperatures, e.g. at from about 25° C. to about 50° C.

Having described the invention in general terms, the following are offered as specific illustrations. It will be understood that they are illustrative only and are not meant to limit the invention.

EXAMPLE 1

A mixture containing a 1:1 molar ratio of the above-described olefin mixture (mol. wt. 325) and of maleic anhydride was stirred while heating to 250° C. over a 2-hour period and was held at 250° C. for another 2 hours to give the $C_{16}$–$C_{28}$ alkenylsuccinic anhydride.

Five hundred grams of this product was mixed with 300 g. (2 moles) of triethanolamine and was stirred while heating to 260° C. over a 5 to 6 hour period.

EXAMPLE 2

A mixture of 500 g. of the succinic anhydride of Example 1 and 1000 g. (2 moles) of Ethomeen S-15 (a polyoxyethylene soyamine made by hydrolyzing soybean oil, converting it to the acid, forming the $C_{16}$–$C_{18}$ primary amine and reacting with 5 moles of ethylene oxide) was stirred to about 260° C. over a 5 to 6 hour period to give the final product.

EXAMPLE 3

Same as Example 1, except that 1 mole of triethanolamine was used.

EXAMPLE 4

Same as Example 1, except that the olefin mixture was dimerized.

EXAMPLE 5

Linoleic acid dimer was reacted with 2 moles of triethanolamine under conditions similar to those disclosed in Example 1.

EXAMPLE 6

Same as Example 4 except that 1 mole of triethanolamine was used.

EXAMPLE 7

Sulfurized mineral oil was prepared by dissolving elemental sulfur in a mineral oil at 230° F. and heating to complete the reaction.

EVALUATION OF PRODUCTS

Tapping Efficiency Test

This test measures the effectiveness of a test composition in metal cutting fluids.

The data in Table 2 were obtained by means of a Tapping Efficiency Test, and in general the procedure thereof involves measurement of torque developed in an internal threading operation employing SAE1020 hot-rolled steel. In this test, thirty torque values are obtained with the test fluid and compared with thirty reference fluid values to obtain percent of tapping efficiency in accordance with the formula $$\% \text{ Tapping Efficiency} = \frac{\text{Avg. of 30 Reference Fluid Torque values} \times 100}{\text{Avg. of 30 Test Fluid Torque Values}}$$

The reference fluid (or blank) employed in the test is shown in the table.

In general, the ability of a cutting oil to operate efficiently is measured by this test. In the test, a series of holes is drilled in a test metal such as SAE1020 hot-rolled steel. The holes are tapped in a drill press equipped with a table which is free to rotate about the center on ball bearings. A torque arm is attached to this "floating table," and the arm in turn activates a spring scale, so that the actual torque during the tapping with the oil being evaluated is measured directly. The same condition used in evaluating the test oil are employed in tapping with a "standard," which has arbitrarily been assigned an efficiency of 100%. The average torque in the test standard is compared with that of the standard and a relative efficiency is calculated on a percentage basis.

Table 2 below summarizes the tapping efficiency data obtained. The data was based on Mobilmet-27 (a cutting oil having a pour point of 30° F., a flash point of 360° F. and a viscosity of 160 SUS at 100° F.) representing 100% efficiency. Proportions are parts by weight.

TABLE 2

| Ex. 1 | Ex. 3 | Ex. 4 | Ex. 5 | Ex. 6 | Ex. 7 | % Efficiency |
|---|---|---|---|---|---|---|
| — | — | — | — | — | 100 | 76% |
| 10 | — | — | — | — | 90 | 114% |
| — | 10 | — | — | — | 90 | 98% |

TABLE 2-continued

| Ex. 1 | Ex. 3 | Ex. 4 | Ex. 5 | Ex. 6 | Ex. 7 | % Efficiency |
|---|---|---|---|---|---|---|
| — | — | 10 | — | — | 90 | 100% |
| — | — | — | 10 | — | 90 | 131% |
| — | — | — | — | 10 | 90 | 80% |

As can be seen from Table 2, the compositions are used in the neat form (i.e. not emulsified), but may be emulsified as hereinbefore indicated.

We claim:

1. An emulsifiable lubricant composition comprising, in the neat form, a sulfurized olefin or sulfurized mineral oil and from about 0.5% to about 95% by weight thereof of (a) the reaction product made by reacting a $C_{12}$ to $C_{20}$ monocarboxylic acid or a dimer thereof or an alkenylsuccinic anhydride or acid wherein the alkenyl is derived from a mixture of $C_{16}$–$C_{28}$ olefins with (1) a hydroxyalkylamine containing 2 to 100 carbon atoms, or (2) a hydroxypolyetheramine of the formula $$\begin{array}{c} RN-R' \\ | \\ R'' \end{array}$$

wherein R is a $C_8$ to $C_{18}$ hydrocarbyl group and x is from 1 to 50, R′ is a $-(CH_2CH_2O)_xCH_2CH_2OH$ group or a $-(CH_2CH_2CH_2O)_xCH_2CH_2CH_2OH$ group and R′ is selected from R and R″; or (b) the reaction product of (a) (2) and a rosin soap; or (c) the product of (a) or (b) and from about 0.5% to about 15% by weight thereof of a $C_2$ to $C_{10}$ monocarboxylic acid.

2. The composition of claim 1 wherein (a), (b) or (c) is present in the neat product to the extent of from about 1% to about 10% by weight.

3. The composition of claim 1 wherein the rosin soap is present with (a) (2) in the neat product to the extent of from about 1% to about 10% by weight.

4. The composition of claim 1 wherein the hydroxylamine is triethanolamine.

5. The composition of claim 1 comprising, in the neat form, 10% by weight of the product obtained by reacting one mole of $C_{16}$–$C_{28}$ alkenylsuccinic acid with 2 moles of triethanolamine and 90% by weight of sulfurized mineral oil.

6. The composition of claim 1 comprising, in the neat form, 10% by weight of the product obtained by reacting one mole of $C_{16}$–$C_{28}$ alkenylsuccinic acid with 1 mole of triethanolamine and 90% by weight of sulfurized mineral oil.

7. The composition of claim 1 comprising, in the neat form, 10% by weight of the reaction product of 1 mole of $C_{16}$–$C_{28}$ dimer alkenylsuccinic acid and 2 moles of triethanolamine and 90% by weight of sulfurized mineral oil.

8. The composition of claim 1 comprising, in the neat form, 10% by weight of the reaction product of 1 mole of linoleic acid dimer and 2 moles of triethanolamine and 90% of sulfurized mineral oil.

9. The composition of claim 7 wherein 1 mole of triethanolamine is used instead of 2 moles.

10. The composition of claim 1 wherein said emulsifiable composition is present in water to the extent of from about 1% to about 50% by weight.

11. The composition of claim 10 wherein the emulsifiable concentrate is present in water to the extent of from about 3% to about 20% by weight.

12. A method of metal working comprising applying to the metal a lubricant composition comprising, in the neat form, a sulfurized olefin or sulfurized mineral oil and from about 0.5% to about 95% by weight thereof of (a) the reaction product made by reacting a $C_{12}$ to $C_{20}$ monocarboxylic acid or a dimer thereof or an alkenylsuccinic anhydride or acid wherein the alkenyl is derived from a mixture of $C_{16}$–$C_{28}$ olefins with (1) a hydroxyalkylamine containing 2 to 100 carbon atoms, or (2) a hydroxypolyetheramine of the formula $$\begin{array}{c} RN-R' \\ | \\ R'' \end{array}$$

wherein R is a $C_8$ to $C_{18}$ hydrocarbyl group and x is from 1 to 50, R′ is a $-(CH_2CH_2O)_xCH_2CH_2OH$ group or a $-(CH_2CH_2CH_2O)_xCH_2CH_2CH_2OH$ group and R′ is selected from R and R″;

(b) the reaction product of (a) (2) and a rosin soap; or (c) the product of (a) or (b) and from about 0.5% to about 15% by weight thereof of a $C_2$ to $C_{10}$ monocarboxylic acid.

13. The method of claim 12 wherein (a), (b) or (c) is present in the neat product to the extent of from about 1 to about 10%.

14. The method of claim 12 wherein the rosin soap is present with (a) (2), in the neat form, to the extent of from about 1% to about 10% by weight.

15. The method of claim 12 wherein the hydroxylamine is triethanolamine.

16. The method of claim 12 wherein the composition used comprises 10% by weight of the product obtained by reacting one mole of $C_{16}$–$C_{28}$ alkenylsuccinic acid with 2 moles of triethanolamine and 90% by weight of sulfurized mineral oil.

17. The method of claim 12 wherein the composition used comprises 10% by weight of the product obtained by reacting one mole of $C_{16}$–$C_{28}$ alkenylsuccinic acid with 1 mole of triethanolamine and 90% by weight of sulfurized mineral oil.

18. The method of claim 12 wherein the composition used comprises 10% by weight of the reaction product of 1 mole of $C_{16}$–$C_{28}$ dimer alkenylsuccinic acid and 2 moles of triethanolamine and 90% by weight of sulfurized mineral oil.

19. The method of claim 12 wherein the composition comprises 10% by weight of the reaction product of 1 mole of linoleic acid dimer and 2 moles of triethanolamine and 90% of sulfurized mineral oil.

20. The method of claim 18 wherein the composition comprises 10% by weight of the reaction product of 1 mole of $C_{16}$–$C_{28}$ dimer alkenylsuccinic acid and 2 moles of triethanolamine and 90% by weight of sulfurized mineral oil.

21. The method of claim 12 wherein the composition is present in water to the extent of from about 1% to about 50% by weight.

22. The method of claim 21 wherein the composition is present in water to the extent of from about 3% to about 20%.

* * * * *

UNITED STATES PATENT AND TRADEMARK OFFICE

CERTIFICATE OF CORRECTION

PATENT NO. : 4,283,293

DATED : August 11, 1981

INVENTOR(S) : Schick et al

It is certified that error appears in the above-identified patent and that said Letters Patent are hereby corrected as shown below:

Col. 1, line 30, "groups U.S." should be --groups. U.S.--.

Col. 1, line 50, "monocarboylic" should be --monocarboxylic--.

Col. 1, line 64, "and R";" should be --and R';--.

Col. 5, line 32, "R'" should be --R"--.

Col. 5, line 32, "R"" should be --R'--.

Col. 6, line 26, "R'" should be --R"--.

Col. 6, line 26, "R"" should be --R'--.

Signed and Sealed this

*Twenty-third* Day of *February 1982*

[SEAL]

*Attest:*

GERALD J. MOSSINGHOFF

*Attesting Officer*

*Commissioner of Patents and Trademarks*